United States Patent [19]

Stephens

[11] Patent Number: 4,723,775

[45] Date of Patent: Feb. 9, 1988

[54] HOOPED AMUSEMENT DEVICE

[76] Inventor: Aunya Stephens, 4014 Warwick, Apt. 304, Kansas City, Mo. 64111

[21] Appl. No.: 919,473

[22] Filed: Oct. 16, 1986

[51] Int. Cl.[4] ..... A63B 5/22; A63B 23/04

[52] U.S. Cl. ..... 272/96; 272/74; 272/93

[58] Field of Search ..... 272/74, 75, 93 446/409, 412, 413, 450, 451, 453; D21/101

[56] References Cited

U.S. PATENT DOCUMENTS

| | | | |
|---|---|---|---|
| 3,109,651 | 11/1963 | O'Donnell | D21/101 X |
| 3,494,069 | 2/1970 | Klinko | 446/450 |
| 3,528,654 | 9/1970 | Larson et al. | 272/74 |
| 4,052,982 | 10/1977 | Ozeryansky | D21/101 X |

FOREIGN PATENT DOCUMENTS

| | | | |
|---|---|---|---|
| 607501 | 7/1926 | France | 446/450 |

*Primary Examiner*—Nancy J. Stodola

*Attorney, Agent, or Firm*—Schmidt, Johnson, Hovey & Williams

[57] ABSTRACT

An amusement device is provided in one embodiment with two annular elements that are integrally connected in coplanar relationship to each other. Each of the annular elements has a diameter within the range of 8 inches to 24 inches for enabling one foot of the user to be readily inserted and thereafter rotated to horizontally swing the device in a horizontal arc, causing the user to intermittently hop on the remaining foot to clear the opposite element during each rotation of the device. Both of the elements are preferably integrally coupled to smooth, rounded, depending bosses which retain the elements in spaced disposition from the ground so that the user can readily insert his or her foot underneath the device to initiate swinging movement thereof. In another form of the invention, a third annular element is coplanar with and interconnects the first and second elements, for increasing the variety of bodily motions and exercise patterns that may be employed.

11 Claims, 6 Drawing Figures

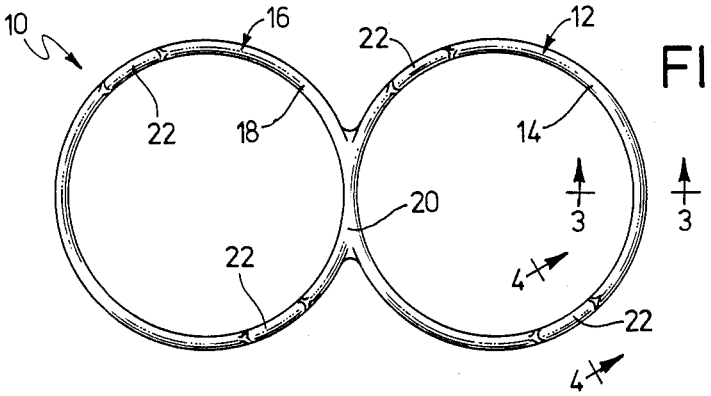
FIG.1
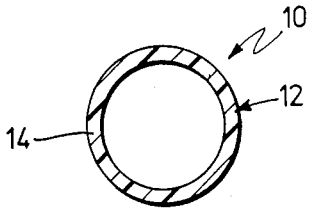
FIG. 3
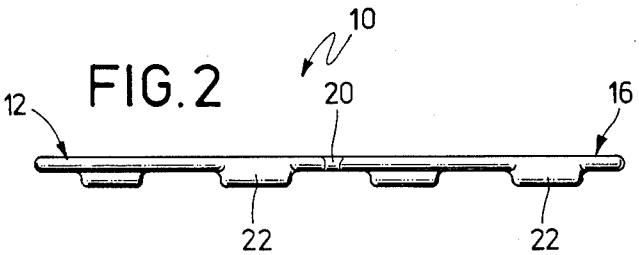
FIG. 2
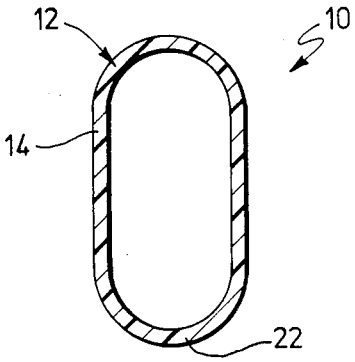
FIG.4
FIG. 6
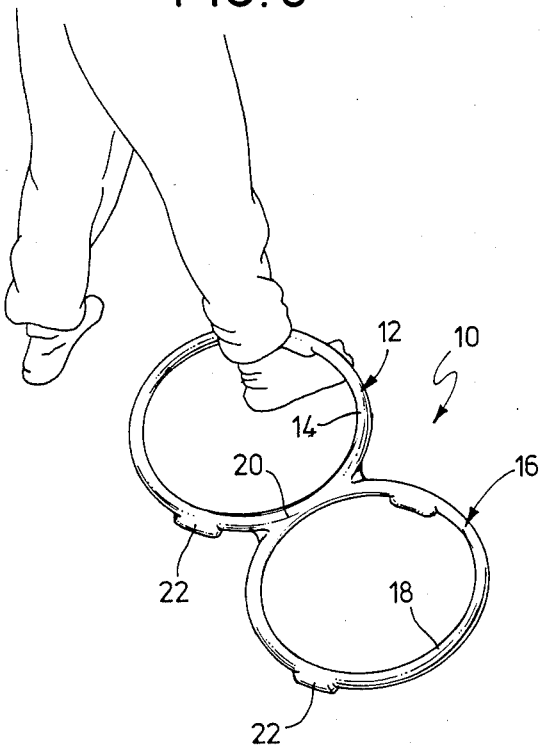
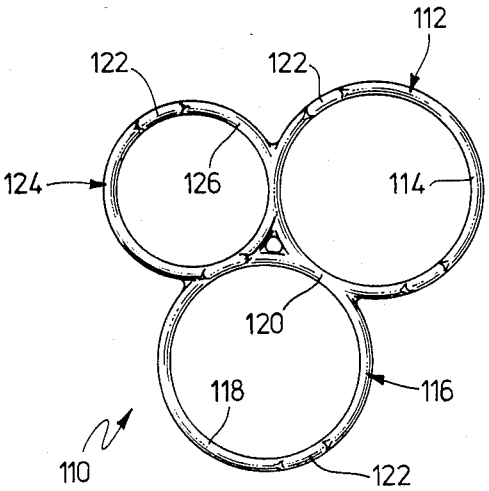
FIG.5

HOOPED AMUSEMENT DEVICE

BACKGROUND OF THE INVENTION

1. Field of the Invention

This invention relates to a device comprising two or more annular, coplanar, integrally connected elements having diameters especially adapted for receiving a human foot of a user. The invention functions as an exercise or amusement device as the user's ankle is quickly rotated in a circle above the ground to swing the device in a horizontal arc. Each rotation of the device requires the user to intermittently lift the other foot during approach of the remaining annular element in order to steadily retain the device in a swinging motion. A plurality of smooth, rounded bosses integrally connected to the underside of the annular elements is operable to retain the annular elements in spaced disposition from the ground to facilitate insertion of the foot below the bottom of the element when the device is to be used.

2. Description of the Prior Art

In the past, a wide variety of exercise devices have been proposed. For the most part, however, exercise devices provide little amusement for the user and instead offer only a single, repetitious method of use which soon causes the athlete to lose interest. As a consequence, such exercise devices are often not utilized for a length of time proper to adequately tone and condition the muscles.

On the other hand, amusement devices which require a certain amount of exercise or aerobic activity have met with widespread public acceptance, since exercise is often a factor secondary to the primary purpose of providing amusement. Devices of this type, such as jump ropes, hula-hoops and sporting equipment, enable the athlete to become engrossed in the method of use of the device, and thereby extend the period of time that the device is used and substantially increase the bodily benefits received as a result of the aerobic movement or exercise correspondingly.

Only a few devices, however, combine the benefits of aerobic exercise with agility, coordination and precise timing of movements. In particular, very few known devices properly condition the foot, ankle and leg muscles of the body. The hula-hoop, for instance, cannot be easily whirled by the foot because the normal, 36 inch or so diameter of the hula-hoop is too large to enable the other foot to be lifted as the hoop swings in a horizontal arc above the ground.

SUMMARY OF THE INVENTION

My present invention represents a novel means for providing amusement as well as aerobic exercise for adults and children alike. The device can be employed in a number of fashions, limited only by the imagination, enabling a person to greatly enjoy use of the device while developing coordination, timing and muscle condition. The variety of interesting methods of use of my invention readily captures the thoughts which increases the likelihood that a person will experience the benefits of aerobic exercise for a longer period of time than would otherwise be possible.

In more detail, the present invention concerns in one embodiment a pair of annular, coplanar elements each having transverse annular cross sections and being of a diameter particularly adapted for convenient use by the ankle of a child or adult. The annular elements are integrally interconnected by a double-yoked splice, and as an ankle is placed within one of the elements and moved in a circle to whirl the first element, the second element swings in a circular, horizontal arc at a distance from the first element, thus requiring the user to intermittently lift the opposite foot in order to retain the device in smooth, steady motion. In one method of use, the device can be moved in an arc by one ankle, and after a period of time the second ankle can be substituted in place of the first ankle without interrupting the steady, swinging movement of the device.

In preferred forms of the invention, two depending bosses are integrally fixed to each of the elements for retaining the remaining areas of the device in spaced disposition from the ground. As a result, the user when initially approaching the looped device can lift the same by placing his or her toes in the space between either of the elements and the ground and thereafter slide the element toward the ankle to initiate swinging movement, so that the athlete need not bend over and lift the device with the hands in order to begin use of the same. Advantageously, all of the bosses have only smooth surfaces and rounded edges for minimizing injury to the user's skin while the device is in motion.

In other forms of the invention, a third annular element, coplanar with the first and second annular elements, is integrally connected to one side of both the first and second annular elements to present an overall, generally triangular configuration for the device. As such, the third annular element enables the device to more easily achieve and retain a certain amount of momentum during swinging movement of the same. Optionally, one of the elements can be of a diameter different from the remaining elements so that a variety of movements may be employed.

BRIEF DESCRIPTION OF THE DRAWINGS

FIG. 1 is a bottom view of my present invention according to one embodiment thereof, wherein two annular elements are interconnected by an integral splice;

FIG. 2 is a side elevational view of the hooped device shown in FIG. 1, illustrating four bosses which depend from the annular elements for retaining the latter in spaced disposition from the ground;

FIG. 3 is a view taken along line 3—3 of FIG. 1, showing the annular cross-sectional configuration of the elements;

FIG. 4 is a view taken along line 4—4 of FIG. 1, depicting the oval configuration of one of the tubular bosses;

FIG. 5 is an illustration of my present invention according to another embodiment, wherein two annular elements are connected by a third annular element having a diameter smaller than the outer elements; and FIG. 6 is a perspective view of the device shown in FIG. 1, illustrating the method of insertion of the foot of the user in the space between one of the annular elements and the ground prior to initiating swinging movement of the device.

DETAILED DESCRIPTION OF THE DRAWINGS

A hooped amusement device 10 according to one embodiment of the invention is depicted in FIGS. 1-4 and 6 and includes a first annular element 12 having an inner circular edge 14, as best illustrated in FIGS. 1 and 6. The first annular element 12 is preferably tubular with a generally cylindrical cross section taken in reference planes radially of the first element 12, as is shown in FIG. 3.

The device 10 also includes a second annular element 16 presenting an inner circular edge 18, and the second element 16 is coplanar with the first element 12. Moreover, the element 16 is tubular and has a cylindrical cross section in reference planes radially of the second element 16, in similar fashion to the cross section of the first element 12.

A means interconnecting the first annular element 12 and the second annular element 16 comprises a double-yoked splice 20 integrally coupled to adjacent segments of the first element 12 and the second element 16. The splice 20 enables the second element 16 to swing in an arc about the first element 12 at a distance from the latter as a human ankle or the like is placed within the first element 12 adjacent the inner circular edge 14 of the same, and the ankle is thereafter moved in a circle to whirl the first element 12.

Preferably, a pair of bosses 22 are integrally fixed to each of the elements 12, 16 as is depicted in FIGS. 1, 2 and 6. When the device 10 is positioned so that the elements 12, 16 lie in a horizontal plane with the bosses 22 beneath respective elements 12, 16, the bosses 22 extend downwardly toward a position of contact with the ground for retaining the elements 12, 16 in spaced disposition from the ground. Advantageously, each of the bosses 12 extends an equal distance outwardly from respective elements 12, 16, so that both of the latter lie in a plane parallel with the ground when all of the bosses are in ground contact.

The bosses 22 are integrally formed with their respective elements 12, 16 and have only smooth surfaces and rounded edges for minimizing injury to the user's skin. As shown in FIG. 4 for exemplary purposes, the bosses 22 have a tubular, oval cross section taken in reference planes radially of respective elements 12, 16.

The inner circular edge 14 of the first element 12 and the inner circular edge 18 of the second element 16 each have diameters in the range of from approximately 8 inches to approximately 24 inches. Better results have been observed when the diameter of the edges 14, 18 is in the range of from approximately 12 inches to approximately 20 inches; however, somewhat better results can be attained when the diameter of the edges 14, 18 are both within the range of from approximately 14 inches to approximately 18 inches. Best results, in one experiment, were observed when the inner circular edge of each element 12, 16 has a diameter of approximately 17 inches.

In use of the device shown in FIGS. 1–4 and 6, the toes of the user are initially inserted in the space between either of the elements 12, 16 and the ground, which space is provided by provision of the depending bosses 22. If the foot is initially placed within the first element 12, as is shown in FIG. 6, the leg is subsequently moved in a manner to shift the inner edge 14 of the element 12 upwardly toward the ankle region of the user, and immediately thereafter the ankle is moved about a horizontal, circular path to initiate motion of the device 10.

As a consequence, the second element 16 will swing in a horizontal arc about the first element 12, while simultaneously the ankle of the user will progressively engage the next adjacent portion of the inner circular edge 14 as the element 12 revolves about the user's leg. However, as the second element 16 approaches the other leg of the user, the other foot must then be lifted to clear passage of the second element 16 therebelow so that steady, swinging motion of the device 10 is preserved. Moreover, since the foot within the first element 12 must be lifted from the ground in order to twirl the device 10, the user must retain balance on the opposite foot while also lifting the same from the ground in a hopping motion whenever the second element approaches a position approximately 180° from the orientation shown in FIG. 6.

As a consequence, rapid, twirling motion of the device 10 readily causes the user to experience an aerobic workout while developing, at the same time, agility, coordination and precise timing of movement. As can be appreciated, swinging of one leg in a horizontal, circular pattern and alternately, synchronously hopping on the other leg during each rotation of the device 10 requires concentration to retain bodily balance, coordinated movement of the body and steady motion of the device 10.

A variety of alternative uses for the device 10 can be readily imagined. For example, it is possible to alternately insert opposite feet within the element 12 without interrupting the swinging, steady movement of the device 10. More advanced pracitioners may desire to vary patterns of movement by switching the feet from the first element 12 to the second element 16.

Referring to FIG. 5, another embodiment of the invention is shown wherein a device 110 has a first element 112 and a second element 116 each with inner circular edges 114, 118, respectively that are constructed in a manenr similar to the elements 12, 16 correspondingly. However, in the embodiment depicted in FIG. 5, a means interconnecting the first element 112 and the second element 116 includes an integral yoke-shaped splice 120 and also comprises a third annular element 124 intermediate and coplanar with the first element 112 and the second annular element 116. All of the elements 112, 116, 124 preferably are provided with depending bosses 122 having only smooth surfaces and rounded corners for minimizing skin injury, in similar fashion to bosses 22.

The third annular element 124 is advantageously tubular with a cylindrical cross section taken in reference planes radially of the third element 124. Moreover, the third element 124 has an inner circular edge 126 coplanar with edges 114, 118.

Good results have been observed in regard to the device 110 when all of the inner, circular edges 114, 118 and 126 have a diameter within the range of from approximately 8 inches to approximately 24 inches. However, better results have been observed when the edges 114, 118 and 126 have a diameter within the range of from approximately 12 inches to approximately 20 inches; however, even better results have been observed when the diameter of each of the edges 114, 118, 126 is within the range of from approximately 14 inches to 18 inches. Best results are provided when the inner circular edges 114, 118, 126 are of a diameter of approximately 17 inches.

As can be appreciated, provision of the third element 124 in offset relationship to the first element 112 and the second element 116 enables a greater amount of momentum to be achieved during swinging movement of the device 110, while also retaining the outer diameters of the outermost elements 112, 116 at measurements feasible for allowing the supporting foot of the user to easily clear the approaching element. Furthermore, addition of the third element 124 increases the variety of bodily motions and/or exercise patterns that may be employed.

As depicted in FIG. 5, the inner edge 126 of the third element 124 may optionally be of a diameter different than the diameter of the inner edges 114, 118 of the elements 112, 116 respectively. Also, it is possible, and within the scope of my present invention, to substitute an elongated bar or other member for retaining the elements 112, 116 and 124 in spaced, coplanar relationship to each other. However, in all forms of the invention, the devices 10, 110 can provide hours of enjoyable use while simultaneously aerobically conditioning the body and developing timing, coordination, balance and mental alertness.

I claim:

1. An amusement device to be whirled by a human ankle comprising:

a first generally annular element presenting an inner, substantially circular edge lying in a reference plane and having a diameter in the range of from approximately 12 inches to approximately 20 inches;

a second generally annular element presenting an inner, substantially circular edge generally coplanar with said circular edge of said first annular element and having a diameter in the range of from approximately 12 inches to approximately 20 inches;

means interconnecting said first annular element and said second annular element for enabling said second element to swing in an arc about said first element at a distance from said first element as a human ankle is placed within said first element adjacent said inner circular edge of said first element and moved in a circle to whirl said first element; and at least one boss having rounded portions and fixedly connected to said first annular element, said at least one boss extending away from said first annular element in a direction generally transverse to said reference plane.

2. The device as set forth in claim 1; including at least one boss fixed to a portion of said second element and extending outwardly from said second element in a direction away from said reference plane substantially parallel with the direction of extension of said at least one boss fixedly connected to said first element, said at least one boss fixed to said second element and said at least one boss fixedly connected to said first annular element having substantially equivalent overall lengths.

3. The device as set forth in claim 2, wherein all of said bosses having only smooth surfaces and rounded edges for minimizing injury to the user's skin.

4. A device as set forth in claim 1, wherein said diameter of said inner circular edge of said first annular element is in the range of from approximately 14 inches to approximately 18 inches.

5. A device as set forth in claim 4, wherein said inner circular edge of said first annular element has a diameter of approximately 17 inches.

6. A device as set forth in claim 1, wherein said first element is tubular.

7. A device as set forth in claim 6, wherein said first element has a generally cylindrical cross section in reference planes radially of said first element.

8. A device as set forth in claim 1, wherein said means interconnecting said first element and said second element comprises a double-yoked splice integrally connecting adjacent segments of said first element and said second element.

9. A device as set forth in claim 1, wherein said means interconnecting said first element and said second element comprises a third annular element intermediate with and coplanar with said first element and said second element, said third element having an inner, substantially circular edge of a diameter within the range of from approximately 12 inches to approximately 20 inches.

10. A device as set forth in claim 9, wherein said diameter of said inner edge of each of said first element, said second element and said third element is in the range of from approximately 14 inches to approximately 18 inches.

11. A device as set forth in claim 9, wherein the diameter of the inner edge of said third element is different from the diameter of said inner edge of said first element and said inner edge of said second element.

* * * * *